US009156300B2

(12) United States Patent
Parkinson et al.

(10) Patent No.: US 9,156,300 B2
(45) Date of Patent: Oct. 13, 2015

(54) GREETING CARD WITH SCROLLING SCENE

(71) Applicant: American Greetings Corporation, Cleveland, OH (US)

(72) Inventors: Michelle Parkinson, Garfield Heights, OH (US); Erin Dennis, Lakewood, OH (US); Seth Larson, Lakewood, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 14/717,004

(22) Filed: May 20, 2015

(65) Prior Publication Data

US 2015/0251479 A1 Sep. 10, 2015

Related U.S. Application Data

(63) Continuation-in-part of application No. 14/559,203, filed on Dec. 3, 2014, now Pat. No. 9,061,539.

(60) Provisional application No. 61/919,515, filed on Dec. 20, 2013.

(51) Int. Cl.
*B42D 15/02* (2006.01)
*B42D 15/04* (2006.01)

(52) U.S. Cl.
CPC ..... *B42D 15/027* (2013.01); *B42D 15/022* (2013.01); *B42D 15/042* (2013.01)

(58) Field of Classification Search
CPC ..... A63F 9/143; A63F 2003/00321; B42D 15/02; B42D 15/022; G09F 11/26; G09F 1/04
See application file for complete search history.

(56) References Cited

U.S. PATENT DOCUMENTS

| | | | | | |
|---|---|---|---|---|---|
| 2,908,087 | A | * | 10/1959 | Weinreich et al. | 434/63 |
| 4,255,889 | A | | 3/1981 | Logan | |
| 4,270,306 | A | * | 6/1981 | Klawitter | 446/7 |
| 5,105,185 | A | * | 4/1992 | Nakanowatari et al. | 345/94 |
| 5,265,889 | A | * | 11/1993 | Kojima | 273/442 |
| 5,515,631 | A | | 5/1996 | Nardy et al. | |
| 5,794,936 | A | * | 8/1998 | Kakizaki | 273/442 |
| 5,942,706 | A | | 8/1999 | Leckie | |
| 6,533,281 | B1 | * | 3/2003 | Kumagai | 273/442 |
| 2002/0095835 | A1 | | 7/2002 | Vanderburg | |
| 2006/0209260 | A1 | | 9/2006 | Clegg | |
| 2009/0126239 | A1 | * | 5/2009 | Clegg | 40/124.03 |
| 2011/0078931 | A1 | * | 4/2011 | Sapp et al. | 40/124.03 |
| 2013/0139418 | A1 | * | 6/2013 | Bogdanski et al. | 40/124.03 |
| 2014/0259817 | A1 | * | 9/2014 | Reynolds et al. | 40/124.02 |
| 2015/0000167 | A1 | * | 1/2015 | Talbot et al. | 40/124.03 |

* cited by examiner

*Primary Examiner* — Gary Hoge
(74) *Attorney, Agent, or Firm* — Christine Flanagan

(57) ABSTRACT

The greeting card of the present invention includes a sound and motor module which enable the greeting card to play audio and activate a scroll mechanism which displays a scrolling scene across a window or screen located on at least one panel of the greeting card. The scroll mechanism contains a piece of thin paper or paper-like material which is attached end-to-end, forming a loop. The material is then placed between two rotating spindles or rollers which rotate the material in a loop across the greeting card page as a moving picture, scene or message. The scroll may contain a greeting, message or simply contain artwork or a funny or entertaining scene. The information on the scroll may be coordinated with the theme of the music or audio clip.

19 Claims, 10 Drawing Sheets

GREETING CARD WITH SCROLLING SCENE

RELATED APPLICATIONS

This application claims priority to U.S. patent application Ser. No. 14/559,203, filed on Dec. 3, 2014, which claims priority to U.S. Provisional Patent Application No. 61/919,515, filed on Dec. 20, 2013. Each of the above-referenced patent applications are incorporated herein by reference it its entirety.

FIELD OF THE INVENTION

The present invention is in the field of social expression products and more specifically, greeting cards.

SUMMARY OF THE INVENTION

The greeting card of the present invention contains a motor module and scroll mechanism which together cause a scenic picture to be scrolled across a miniature screen on an inside surface of the greeting card. A sound module also provides audio playback upon activation. The scenic picture is printed on a thin substrate which is attached at each free end forming a closed loop. The material is placed between two rollers which are in contact with a gear mechanism that is put into motion when the motor module is activated. In addition to the moving scenic picture, a die cut shaped character is attached to a spring and located proximate to the moving scenic picture such that when the motor module is activated, the vibration from the motor causes the die cut shaped character to wobble or bounce on the spring, giving the illusion that the die cut shaped character is interacting with the moving scenic picture.

DETAILED DESCRIPTION OF PREFERRED AND ALTERNATE EMBODIMENTS

Figure 1:
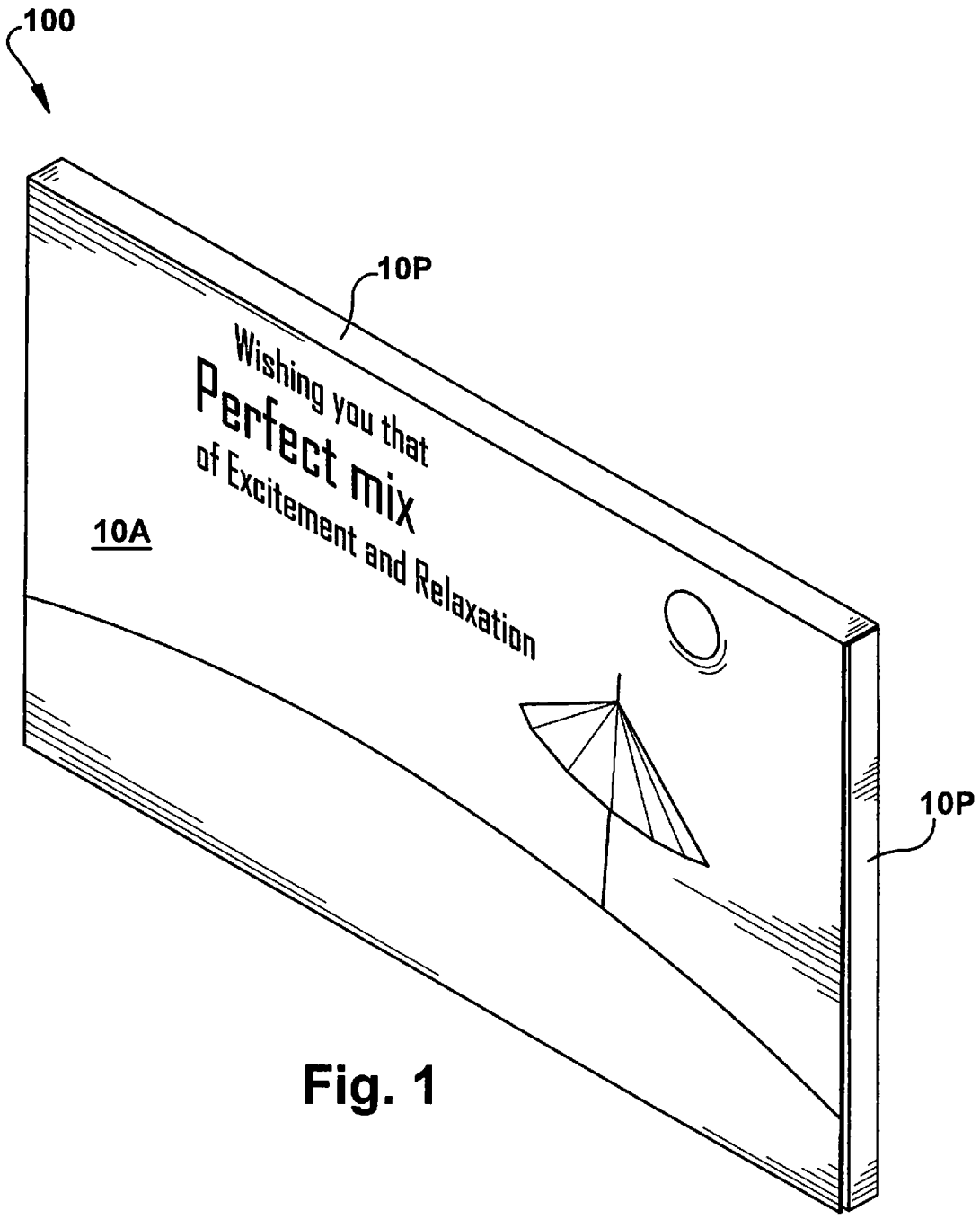
FIG. 1 is a perspective view of the greeting card of the present invention, in a closed position.
Figure 2:
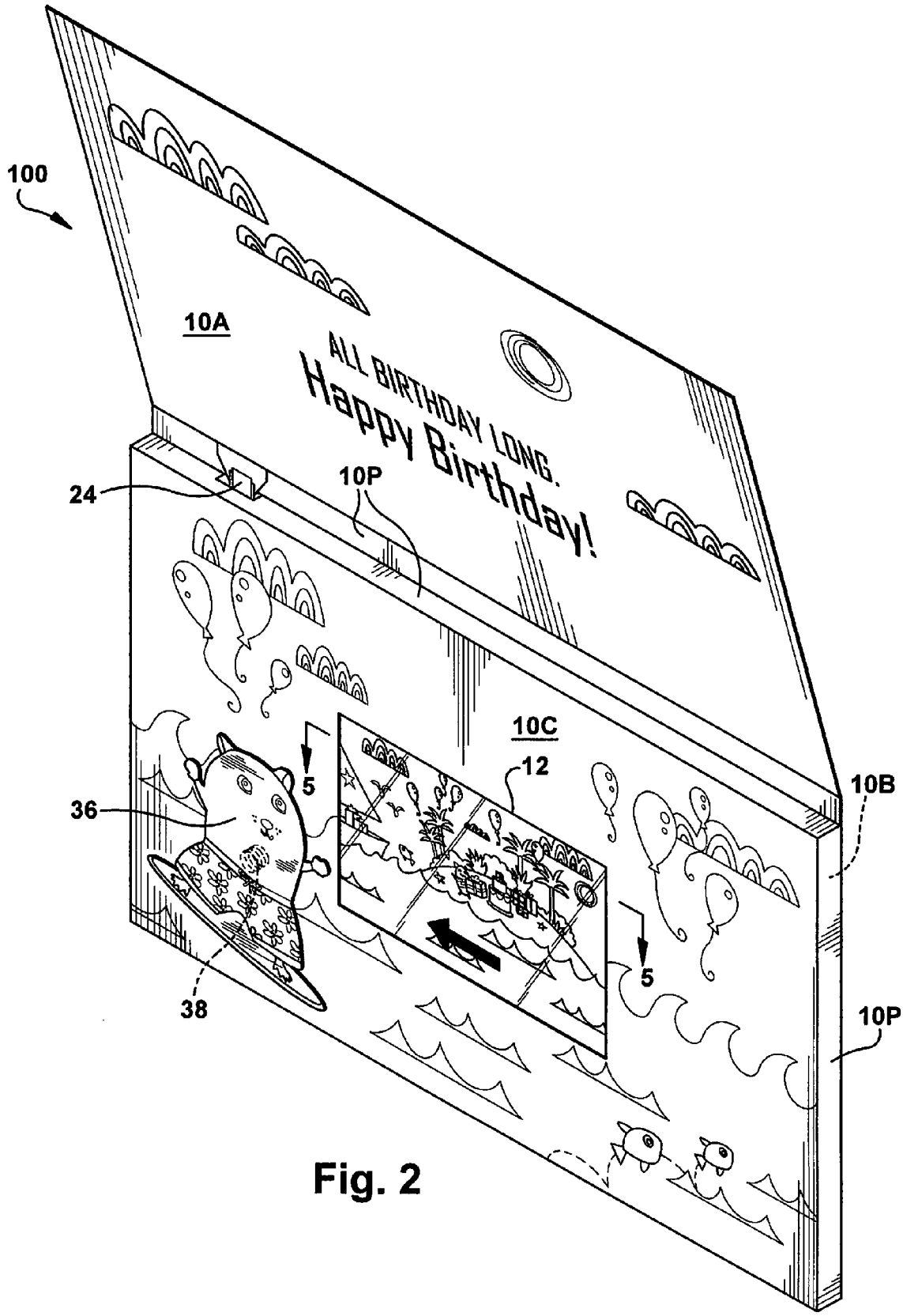
FIG. 2 is a perspective view of the greeting card of FIG. 1, in an open position.
Figure 3:
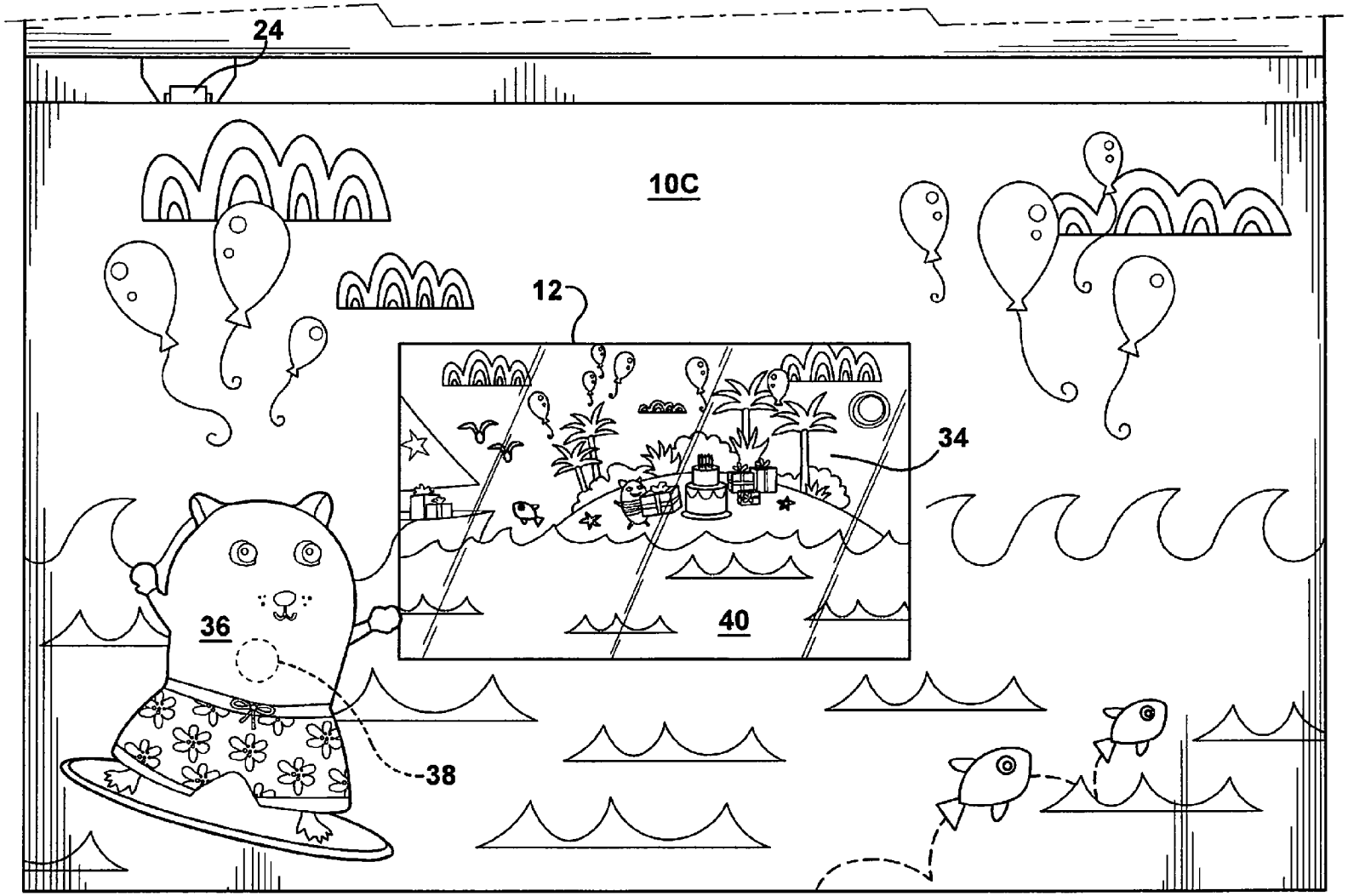
FIG. 3 is a front view of an inside panel of the greeting card of FIG. 1.
Figure 4:
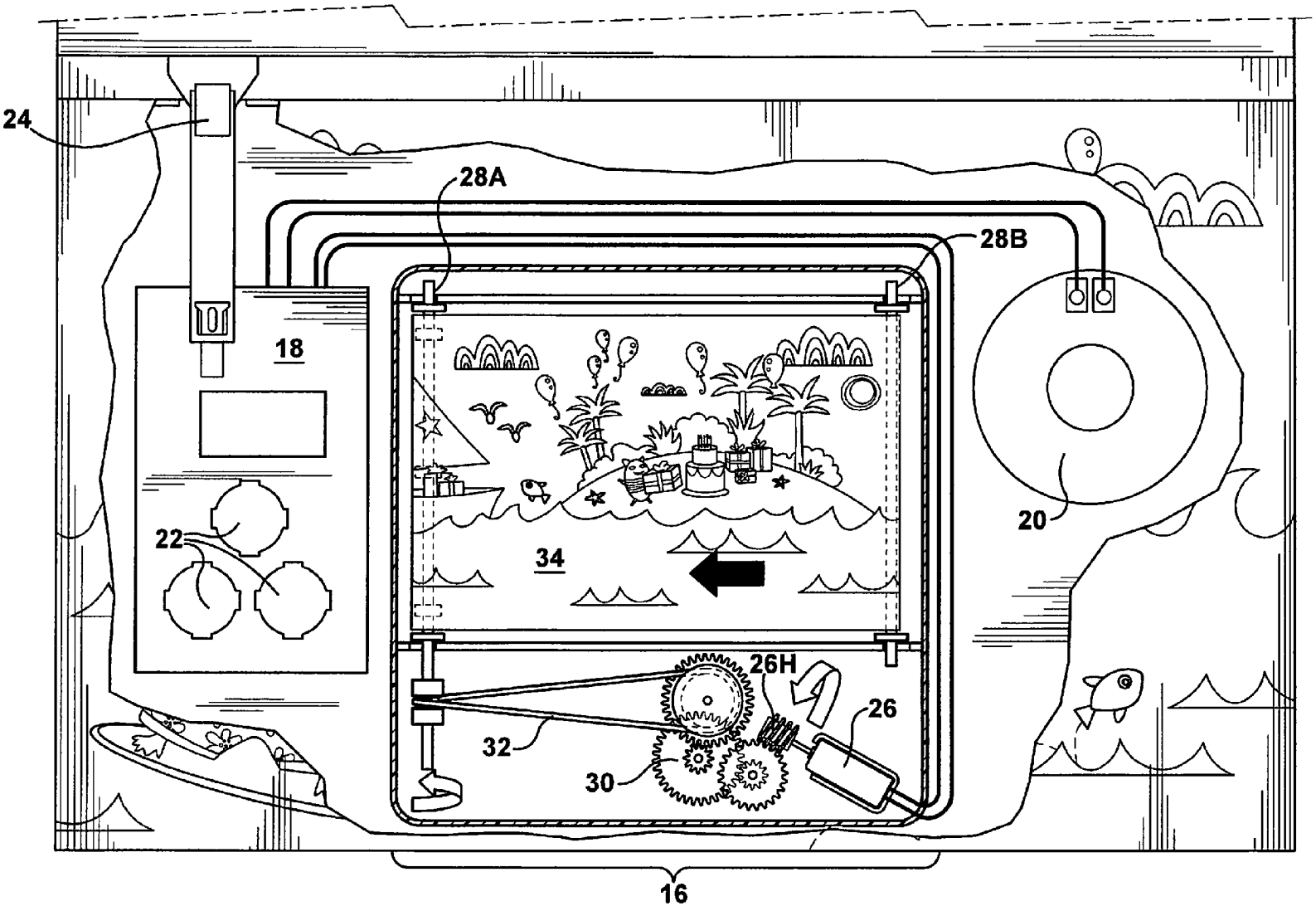
FIG. 4 is a tear-away view of the inside panel shown in FIG. 3.
Figure 5:
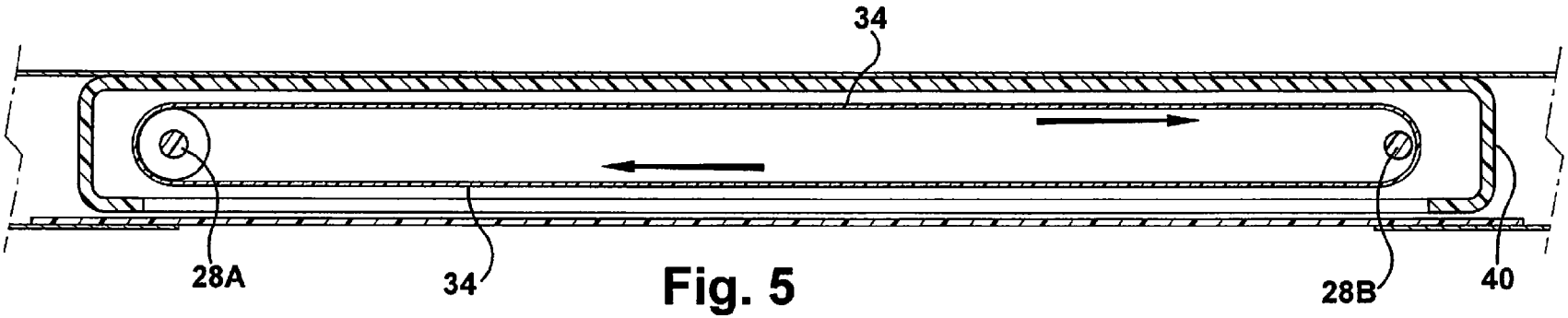
FIG. 5 is a cross-sectional view of the scroll mechanism of FIG. 2, from the perspective of arrows 5-5.
Figure 6:
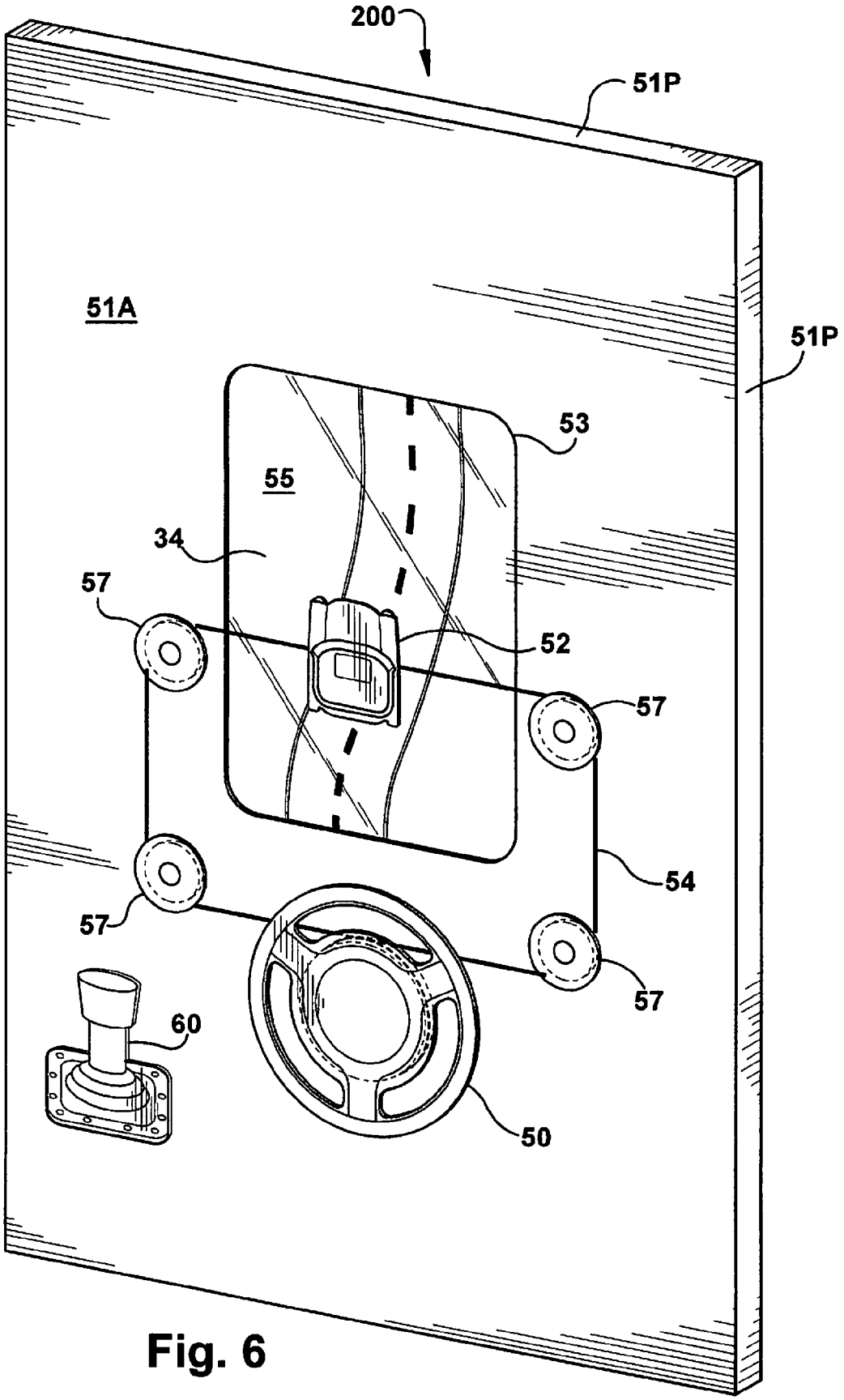
FIG. 6 is a perspective view of an alternate embodiment of the greeting card of the present invention.
Figure 7:
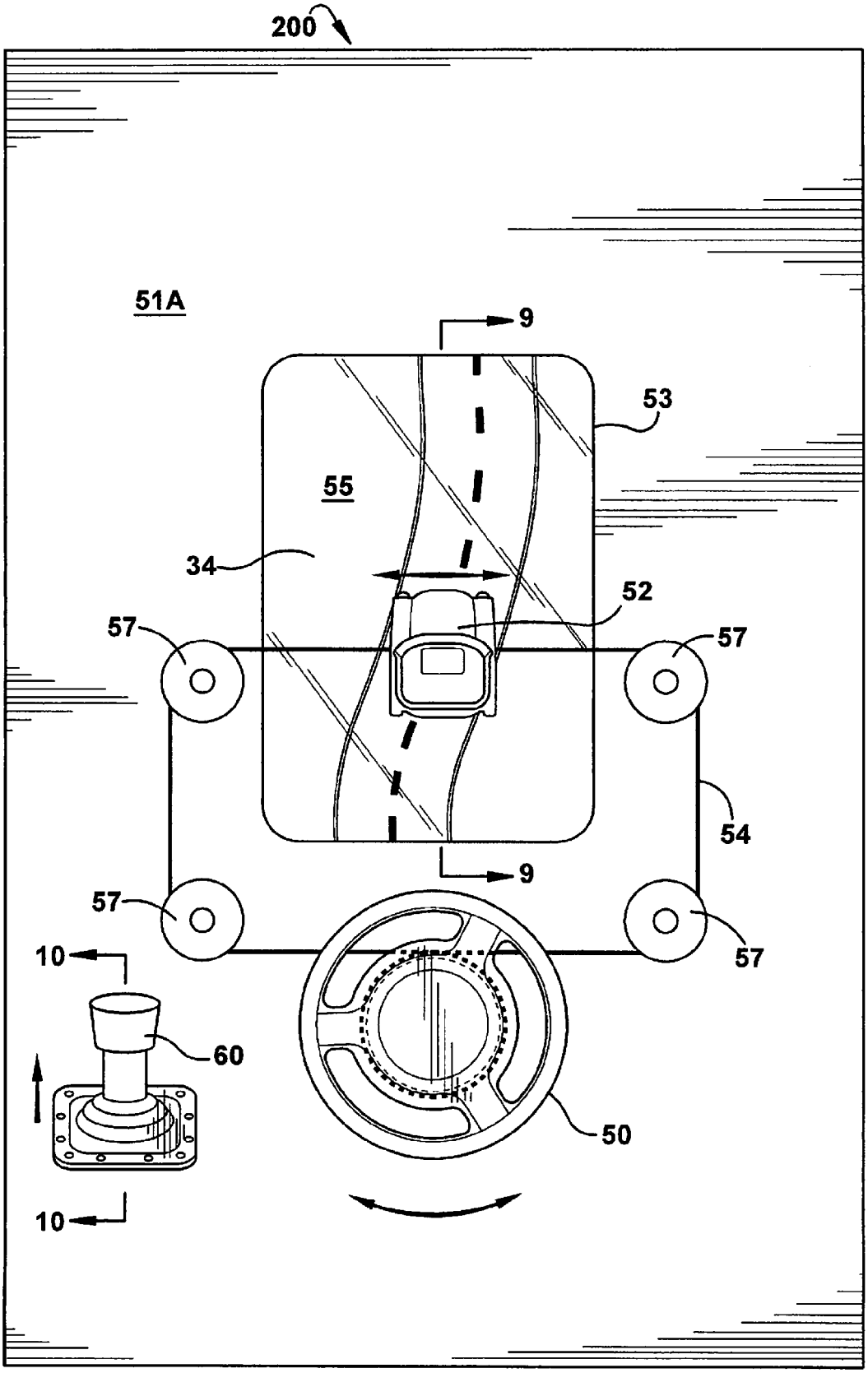
FIG. 7 is a front view of the greeting card of FIG. 6.

The greeting card of the present invention includes a sound and motor module which enable the greeting card to play audio and activate a scroll mechanism which displays a scrolling scene across a window or screen located on at least one panel of the greeting card. The scroll mechanism contains a piece of thin paper or paper-like material which is attached end-to-end, forming a loop. The material is then placed between two spindles or rollers which rotate the material in a loop across the greeting card page as a moving picture, scene or message. The scroll may contain a greeting, message or simply contain artwork or a funny or entertaining scene. The information on the scroll may be coordinated with the theme of the music or audio clip.

The greeting card 100 includes a multi-panel greeting card body having two or more panels 10 connected along various fold lines. The panels 10 may be main panels or side panels which cover the sides or thickness of the greeting card 100 around the perimeter. The panels 10 may be made of typical greeting card material such as paperboard or may be of a heavier card stock. The panels 10 of the greeting card 100, in a preferred embodiment, are contained in a single contiguous sheet which is folded along the various fold lines to wrap or envelope the inner components of the greeting card 100. However, the greeting card 100 may be comprised of two or more separate panels which are attached together around the inner components of the greeting card 100. Each of the panels 10 may contain printing thereon such as text sentiment, artwork, drawings, photos or even three-dimensional embellishments attached thereto. The greeting card panels 10 may be arranged in a standard portrait orientation or may also be arranged in a landscape orientation which provides more space for the internal components to be attached along the width of one or more greeting card panels 10. In a preferred embodiment, the greeting card contains a first main panel 10A, a second main panel 10B and a third main panel 10C. Smaller, narrow side or perimeter panels 10P are located between each of the main panels and also along the side edges of the third main panel 10C. The third main panel 10C contains an opening 12 thereon through which the scrolling mechanism 14 can be viewed. The opening 12 may be of any shape and size but in a preferred embodiment, the opening 12 is a rectangular shaped opening 12 located proximate to the center of the greeting card panel 10B. The sides of the opening 12 may be linear or non-linear and decorative, like a picture frame. The opening 12 may contain a clear or transparent sheet of acetate or other transparent material 40 thereon, through which the scrolling mechanism 14 is viewed. The transparent material 40 protects the scrolling mechanism 14 from damage while still providing visibility therethrough. Each of the main greeting card panels 10A, 10B, 10C and the side or perimeter panels 10P contain a front surface and a rear surface opposite the front surface. A foam frame 16 is inserted between the second 10B and third 10C main greeting card panels. The second 10B and third 10C main greeting card panels along with the side or perimeter panels 10P cover or envelope and conceal the foam frame 16 therebetween. The foam frame 16 creates a thickness which is wide enough to contain the internal components of the greeting card while maintaining a planar outer surface.

Contained between two main greeting card panels 10B, 10C are the electronic and other internal components of the greeting card 100. These components may be attached directly to the one of the greeting card panels 10B, 10C or may be attached to a substrate which is then attached to one of the greeting card panels 10B, 10C. These components may include, but are not limited to: a printed circuit board 18, an integrated circuit chip, a speaker 20, a power source 22, a switch 24, a motor 26; a scroll mechanism 16 with attached paper or paper-like material wound about a portion of the scroll mechanism.

The scrolling mechanism contains a two spindles or rollers 28A, 28B, a small motor 26, a gear mechanism 30, a rubber band 32, and a scroll sheet 34 which is attached end to end, forming a loop. The entire scrolling mechanism 16 is contained within a hard plastic shell 40. The miniature motor 26 contains a small gear head 26H which when activated spins or rotates. The gear head 26H is in contact with at least one of a plurality of gears 30 contained in the gear mechanism. Once the motor 26 is activated the gear head 26H rotates, causing the gears 30 of the gear mechanism to rotate as well. Two spindles or rollers 28A, 28B are positioned parallel to and spaced apart from each other at a distance that is approximately equal to the width of the scroll sheet loop 34. A small rubber band 32 is looped at one end around one of the gears 30 and at the opposite end around one of the rollers 28A. The scroll sheet loop 34 is attached between the two rollers or spindles 28A, 28B. Therefore, when the motor 26 is activated, the gear head 26H turns the gears 30 in the gear mechanism which in turn causes rotation of one of the spindles or rollers 28A, 28B via the rubber band 32. The scroll sheet 34 then scrolls or loops continuously between the two rollers 28A, 28B for as long as the motor 26 is activated. The scroll sheet loop 34 is made of a very thin material which has a pleasant scene or message printed thereon. The scene is printed from one edge of the film to the opposite edge. The two vertical ends or edges of the material 34 are attached to one another, forming a loop. Once the loop 34 is attached between the rollers 28A, 28B and the motor 26 is activated, the material 34 scrolls across the "screen" from left to right and is visible through the opening 12 in the greeting card panel 10B and the acetate screen or cover. The scroll material loop 34 continues to rotate about the two rollers 28A, 28B until the motor module 26 is deactivated. The motor module 26 is activated by a slide switch 24 which is located between two main greeting card panels such that when the greeting card 100 is opened by pivoting one greeting card panel 10A away from the other 10C, the slide tongue moves, causing activation of the motor 26 and movement of the scrolling scene 34. When the greeting card 100 is closed by pivoting the greeting card panel 10A back over the other panel 10C, the motor 26 becomes deactivated. In addition to the motor 26, the slide switch 24 also controls activation of a sound module which is operative to store and playback at least one audio clip. Therefore, when the greeting card 100 is opened, both the motor 26 and sound modules are activated causing movement of the scrolling scene 34 and playback of audio. In an alternate embodiment, a push button switch may be used to control activation of the sound and motor modules. The push button switch may be accessed through the front cover of the greeting card or any other panel of the greeting card. Likewise, other types of switches may be used.

On an inside panel of the greeting card 10B, proximate to the opening 12 through which the scrolling scene 34 is visible, a die cut shape 36 is attached to a spring 38 which is attached to the greeting card panel 10B. The vibration caused from the motor 26 moving the scroll 34 between the two rollers 28A, 28B, causes the die cut shape 36 to vibrate or wobble at the end of the spring 38. The die cut shape 36 and the scrolling scene 34 may be designed as part of a larger scene. For example, the scrolling scene 34 may depict a road running through a town or city with buildings, trees, houses, etc. in the background. The die cut shape 36 may look like a person sitting in a little car so when the die cut shape 36 bounces or vibrates on the spring 38 when the motor 26 is activated, it gives the appearance that the person in the little car is traveling along the road depicted in the scrolling scene 34. As another example, as shown in the figures, the scrolling scene 34 may contain body of water with an island, trees, birds, and boats in the background. The die cut shape 36 may be a person in on a surfboard so that when the motor 26 is activated it appears as if the surfer is surfing on the water in the scene. Of course, the greeting card panel 10B may also contain artwork which blends in with the scenery of the scrolling scene 34 and the die cut shape 36. The audio clip may also be coordinated with the theme of the scrolling scene 34, die cut shape 36, and greeting card 100.

In an alternate embodiment of the greeting card of the present invention, shown in FIGS. 6-11, the greeting card 200 contains additional features for increased user interaction. The greeting card 200 contains a wheel or other control device 50 which can be manipulated by a user to move a die cut shape (or other small accessory) 52 atop or proximate to the scrolling scene 34.

The greeting card 200 of this embodiment includes a multi-panel greeting card body 51 having two or more panels connected along various fold lines. The panels may be main panels or side panels which cover the sides or thickness of the greeting card around the perimeter. The panels may be made of typical greeting card material such as paperboard or may be of a heavier card stock. The panels of the greeting card 200, in a preferred embodiment, are contained in a single contiguous sheet which is folded along the various fold lines to wrap or envelope the inner components of the greeting card 200. However, the greeting card may be comprised of two or more separate panels which are attached together around the inner components of the greeting card 200. Each of the panels may contain printing thereon such as text sentiment, artwork, drawings, photos or even three-dimensional embellishments attached thereto. The greeting card panels may be arranged in a standard portrait orientation or may be arranged in a landscape orientation. In a preferred embodiment, the greeting card contains a front or cover panel 51A, an inside left panel (not shown), an inside right panel (not shown) and a back panel (not shown). Smaller, narrow side or perimeter panels 51P may be located between one or more of the main panels. The front panel 51A (and inside left panel) may contain an opening thereon 53 through which a scrolling scene 34 is visible. In a preferred embodiment, the opening 53 may be square or rectangular but can be any shape, size or orientation. The opening 53 may contain a clear or transparent sheet of acetate or other transparent material 55 thereon, through which the scrolling scene 34 is visible. The transparent material 55 protects the scrolling scene 34 from damage while still providing visibility therethrough. A foam frame is inserted between the right inside panel and the rear greeting card panel. The right inside and rear greeting card panels, along with one or more side or perimeter panels 51P, cover or envelope and conceal the foam frame therebetween. The foam frame creates a thickness which is wide enough to contain the internal components of the greeting card while maintaining a planar outer surface.

Contained between at least two main greeting card panels are the electronic and other internal components of the greeting card 200. These components may be attached directly to the one of the greeting card panels or may be attached to a substrate which is then attached to one of the greeting card panels. These components may include, but are not limited to: a printed circuit board 56, an integrated circuit chip, a speaker 57, a power source 58, a switch 59, a motor 26, a memory storage device, a scroll mechanism 16 having a paper or paper-like material wound about a portion thereof, and any other electronic component which is required or which facilitates motor movement, audio capabilities and any other special effect.

Figure 8:
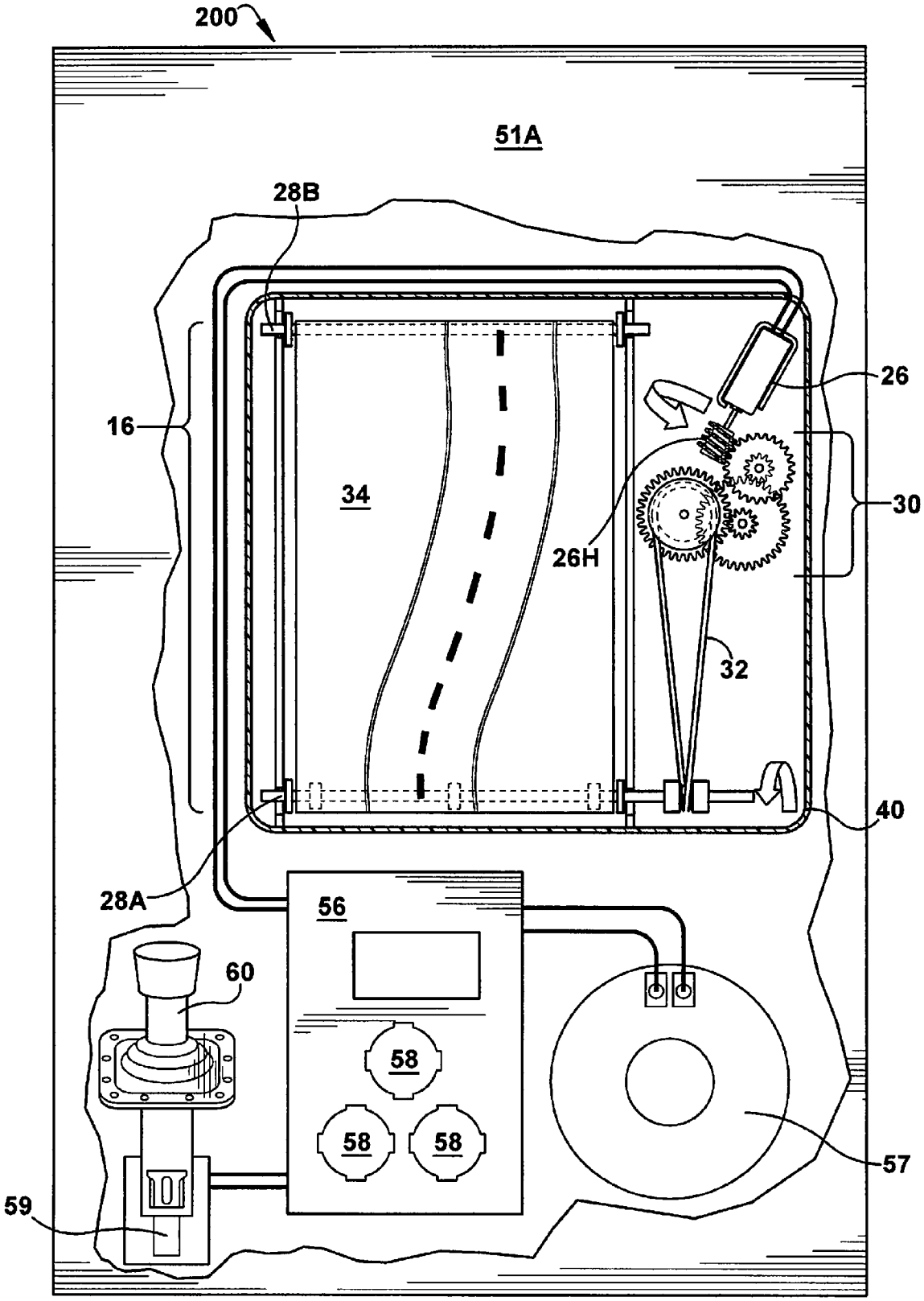
FIG. 8 is a front tear-away view of the greeting card of FIG. 6.
Figure 9:
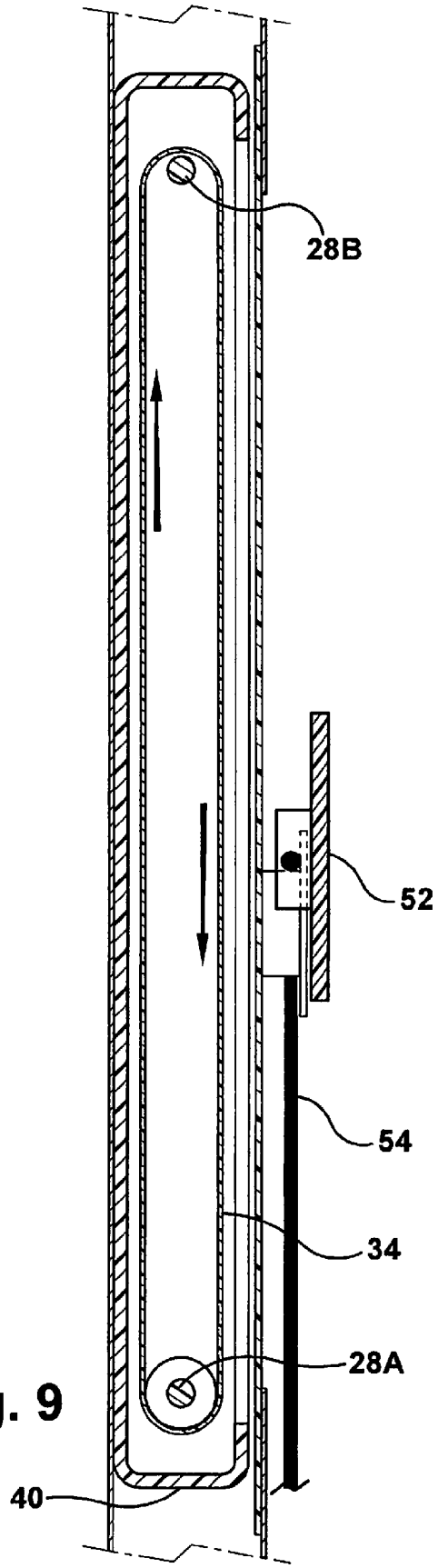
FIG. 9 is a cross-sectional view of the scroll mechanism inside the greeting card of FIG. 6, from the perspective of arrows 9-9.

As shown in FIG. 8, the scrolling mechanism 16 contains a two spindles or rollers 28A, 28B, a small motor 26, a gear mechanism 30, a rubber band 32, and a scroll sheet 34 which is attached end to end, forming a loop. The entire scrolling mechanism 16 is contained within a hard plastic shell 40. The miniature motor 26 contains a small gear head 26H which when activated spins or rotates. The gear head 26H is in contact with at least one of a plurality of gears 30 contained in the gear mechanism. Once the motor 26 is activated the gear head 26H rotates, causing the gears 30 of the gear mechanism to rotate as well. Two spindles or rollers 28A, 28B are positioned parallel to and spaced apart from each other at a distance that is approximately equal to the width of the scroll sheet loop 34. A small rubber band 32 is looped at one end around one of the gears 30 and at the opposite end around one of the rollers 28A. The scroll sheet loop 34 is attached between the two rollers or spindles 28A, 28B. Therefore, when the motor 26 is activated, the gear head 26H turns the gears 30 in the gear mechanism which in turn causes rotation of one of the spindles or rollers 28A, 28B via the rubber band 32. The scroll sheet 34 then scrolls or loops continuously between the two rollers 28A, 28B for as long as the motor 26 is activated. The scroll sheet 34 is made of a very thin material which has a scene or message printed thereon. The scene is printed from one edge of the film to the opposite edge. The two ends or edges of the material 34 are attached to one another, forming a loop. Once the loop 34 is attached between the rollers 28A, 28B and the motor 26 is activated, the material 34 scrolls across the "screen" and is visible through the opening 53 in the greeting card and the acetate screen or cover 55. The scroll material loop 34 continues to rotate about the two rollers 28A, 28B until the motor module 26 is deactivated. In this embodiment, the two spindles or rollers 28A, 28B are placed in a horizontal configuration with the scroll sheet 34 looping between the spindles or rollers 28A, 28B in an up and down direction, as shown in the figures.

The front panel of the greeting card 51A contains a circular wheel (or steering wheel) 50 which can be moved in both a clockwise and counterclockwise circular motion. A string (or any other type of thin elongate filament) 54 is wound around the wheel 50 and also around four circular spools (also referred to as reels or windings) 57 which are arranged in a rectangular configuration (with a spool 57 located at each corner of the rectangle). The wheel 50 serves to move the string 54 around the four spools 57 in a rectangular pattern. A small die cut shape 52 is attached to the string 54 along a top edge of the rectangle (between the top two corner spools). When the wheel 50 is turned, it causes the string 54 to move which in turn causes the die cut shape 52 to move along the string 54 along the upper edge of the rectangle between the two upper spools. When the wheel 50 is turned to the right, the die cut shape 52 moves to the left and when the wheel 50 is turned to the left, the die cut shape 52 moves to the right. The four spools 57 and much of the rectangular string arrangement 54 may be hidden from view by an extra overlying panel so that it is not visible to the user. The string 54 to which the die cut shape 52 is attached may be transparent, similar to fishing line, to make it less visible to the user. The die cut shape 52 is located above the opening 53 on the greeting card panel 51A and the transparent material covering 55 the opening 53. The movement of the die cut shape 52 is intended to interact with the scene printed on the scroll material 34. In the embodiment shown in FIGS. 6 and 7, the die cut shape 52 is formed and printed to look like a small car. The scroll material 34 contains a driving scene thereon with a road or track and having several items or roadblocks printed along the road. Therefore when the scroll material 34 is put in motion and moves around the two spindles or rollers 28A, 28B in an up and down direction, the die cut shape (car) 52 can be moved left or right by the wheel (steering wheel) 50 to avoid the roadblocks printed on the scrolling scene 34.

Figure 10:
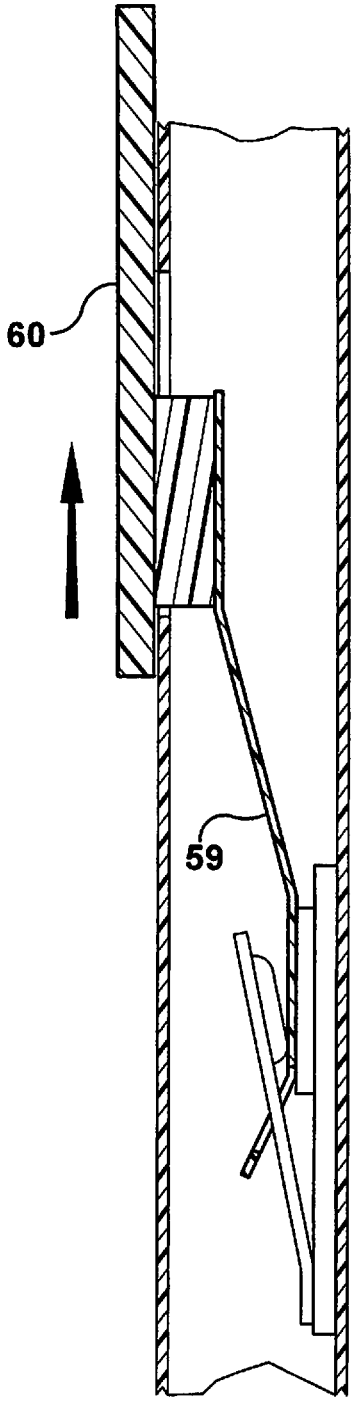
FIG. 10 is a cross-sectional view of the lever on the greeting card of FIG. 7, in a first position, from the perspective of arrows 10-10.
Figure 11:
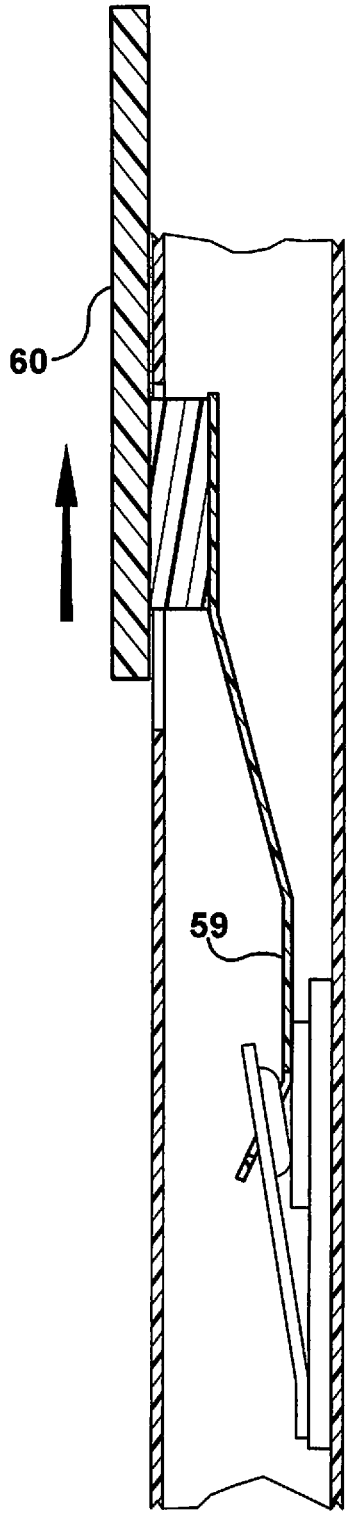
FIG. 11 is a cross-sectional view of the lever on the greeting card of FIG. 7, in a second position, from the perspective of arrows 10-10.

The motor module 26, which is operative to move the scroll material 34 between and around the two spindles or rollers 28A, 28B, is activated by a slide switch 59 which is located between the front cover panel 51A and the inside left panel (not shown) of the greeting card 200. The slide switch mechanism 59 is attached to a lever 60, which in the figures is a die cut shape formed and printed to resemble a gear shifter. When the lever (gear shifter) 60 is pulled downward, it causes the slide tongue 59 to move, thereby activating the motor 26 and causing movement of the scrolling scene 34, as shown in FIG. 11. When the lever (gear shifter) 60 is moved in an upward direction, back to its original position, the slide tongue 59 moves back into place, thereby deactivating the motor 26 and movement of the scrolling scene 34, as shown in FIG. 10. In addition to the motor 26, the slide switch 59 also controls activation of a sound module which is operative to store and playback at least one audio clip. Therefore, when the lever (gear shifter) 60 is pulled down, both the motor 26 and sound modules are activated causing movement of the scrolling scene 34 and playback of audio.

While this embodiment of the greeting card of the present invention has been described herein and shown in the figures as having a car theme, with circular steering wheel as the user interactive movement control device, gear shift lever controlling slide switch and die cut moveable car with related auto or road-related scrolling scene, the greeting card may have an entirely different theme or themes which would change the look, shape and feel of the movement control device, slide switch movement mechanism, die cut shape and scene printed on the scroll. The implementation of the trigger mechanism can take on a variety of different types, such as various trigger or switch mechanisms, including but not limited to: touch activated, sound activated, light activated, movement activated, push button, flap sensor, slide tongue, crank, lever, and pull string or pull tab. The implementation of the device movement mechanism can take on a variety of different types, including but not limited to: wheel, slide lever, direction control buttons, knob, and joystick. The interaction between the moveable die cut shape and the scrolling scene make take on different variations in terms of the size, shape and look of the die cut shape and its orientation or location with respect to the scrolling scene and the types of scenes which are printed on the scroll sheet material can be virtually any type of scene, picture, drawing, graphic, etc. The placement of the particular components of the greeting card can also be changed while remaining within the scope of the present disclosure. For example, the steering wheel, die cut shape, string movement device and gear shifter lever trigger mechanism have been described herein and shown in the figures as being located on the front face or page of the greeting card. However, they can be located any greeting card page and may be contained on the inside of the greeting card as opposed to the outside of the greeting card. The number of pages of the greeting card may vary and the greeting card may not have any moveable pages but can be a single rectangular hand held device with or without a greeting printed thereon as opposed to having the look of a traditional greeting card with at least one sentiment panel which can be opened and closed by pivoting the panel about a fold line. The scrolling mechanism may be oriented in a vertical or horizontal configuration and may be located at different angles or locations with respect to the moveable die cut shape. The string mechanism has also been described herein as having four corners or spools around which the string is wound, creating a square or rectangular configuration. However, the string mechanism may have more than four or fewer than four spools around which the string is wrapped. Any number of spools may be arranged in any type of configuration (square, triangle) to facilitate the angle and length of path upon which the moveable die cuts shape may travel. The die cut shape may be replaced with a small plastic (or other material) figurine or other small, lightweight adornment. The string mechanism may contain actual string, fishing line, fiber optic cable, small gauge wire, or any other thin, lightweight, suitable material.

In another embodiment of the present invention, the scrolling mechanism described above with respect to the two greeting card embodiments, is inserted into a gift bag or gift box to add entertainment value to gift packaging.

As described above with respect to the greeting card embodiments of the present invention, the scrolling mechanism contains a two spindles or rollers 28A, 28B, a small motor 26, a gear mechanism 30, a rubber band 32, and a scroll sheet 34 which is attached end to end, forming a loop. The entire scrolling mechanism 16 is contained within a hard plastic shell 40. The miniature motor 26 contains a small gear head 26H which when activated spins or rotates. The gear head 26H is in contact with at least one of a plurality of gears 30 contained in the gear mechanism. Once the motor 26 is activated the gear head 26H rotates, causing the gears 30 of the gear mechanism to rotate as well. Two spindles or rollers 28A, 28B are positioned parallel to and spaced apart from each other at a distance that is approximately equal to the width of the scroll sheet loop 34. A small rubber band 32 is looped at one end around one of the gears 30 and at the opposite end around one of the rollers 28A. The scroll sheet loop 34 is attached between the two rollers or spindles 28A, 28B. Therefore, when the motor 26 is activated, the gear head 26H turns the gears 30 in the gear mechanism which in turn causes rotation of one of the spindles or rollers 28A, 28B via the rubber band 32. The scroll sheet 34 then scrolls or loops continuously between the two rollers 28A, 28B for as long as the motor 26 is activated. The scroll sheet 34 is made of a very thin material which has a scene or message printed thereon. The scene is printed from one edge of the film to the opposite edge. The two ends or edges of the material 34 are attached to one another, forming a loop. Once the loop 34 is attached between the rollers 28A, 28B and the motor 26 is activated, the material 34 scrolls across a "screen" and is visible through an opening 12 in the gift bag or gift box and optional acetate screen or cover. The scroll material loop 34 continues to rotate about the two rollers 28A, 28B until the motor module 26 is deactivated. The two spindles or rollers 28A, 28B can be placed in a parallel horizontal or vertical configuration with the scroll sheet 34 looping between the spindles or rollers 28A, 28B in an up and down or a left to right direction.

With regard to the gift bag, the gift bag may be of a conventional design, having a front panel, a back panel opposite the front panel, with two side panels extending therebetween. The width of the side panels controls the width of the gift bag. A bottom panel connects each of the front, back, and side panels, to create a closed end to the gift bag. Opposite the closed end is an open end for insertion of a gift or other items into the gift bag. The side panels may contain a vertical bisecting crease or fold line, which enables the bag to be neatly folded and packaged for retail sale. The gift bag may also contain two handles, one handle attached to the front panel and one handle attached to the back panel. The handles may be similar to a cord or rope-like structure, which extend between two holes or openings positioned proximate to the upper edges of the front and back panels along the open end of the gift bag. For each handle, a single piece of cord or rope-like structure is used. The two free ends of a first cord are inserted into the two holes in the front panel of the gift bag and two free ends of a second cord are inserted into the two holes in the back panel of the gift bag. The cords may be inserted into each hole from the outside of the bag to the inside of the bag where each free end of the cord is tied or knotted for secure attachment to the gift bag or alternatively, the cords may be inserted form the inside of the bag to the outside of the bag, where each free end is then tied or knotted. Alternatively, the handles may be die cut out of the front and back panels of the gift bag. Handles may be attached from gusset to gusset or may be taped, glued or otherwise attached to the inside of the gift bag. The gift bag may also contain other types of handles, such as paperboard handles, plastic handles, or any other type of suitable handle with appropriate attachment mechanisms. The gift bag panels may contain drawings, images, photos or other printed indicia thereon. The printing on the gift bag may be coordinated with the shape, color or theme of the moving attachment. Also, the gift bag panels may be traditionally shaped in the form of a rectangle, or the panels may take on a non-linear, decorative free edge to add to the decorative effect of the gift bag. The gift bag may come in a variety of different shapes and sizes.

One or more of the gift bag panels may be double-walled so that the electronic components of the gift bag may be housed between two panels of the gift bag. The electronic component may include, but are not limited to: a printed circuit board, an integrated circuit chip, a speaker, a power source, a switch, a motor; a scroll mechanism having a paper or paper-like material wound about a portion thereof, or any other component which is required or which facilitates motor movement, audio capabilities, or any other special effect. At least one outer portion of a double-walled panel contains an opening thereon through which the scrolling mechanism is visible. The opening may have a clear or transparent sheet of acetate or other transparent material thereon, through which the scrolling mechanism is visible. The motor may be activated and thereby cause the scroll sheet to move between and around the two spindles or rollers by a variety of different ways, including but not limited to: a push button, a pull-tab or pull-string, a tilt switch, a movement-sensitive switch, a zipper-activated switch, a clasp-activated switch, a touch-activated switch, a slide tongue switch, and a contact switch. A sound module may also be contained along with the electronic components within the gift bag, the sound module operative to store and playback at least one audio file. The audio may be triggered simultaneous with the motor and movement of the scrolling scene, using the same switch or trigger mechanism, or two separate switches or triggers may control operation of the sound module and the motor. The scroll mechanism is placed within the at least one double-walled gift bag panel behind the opening therein and behind the optional transparent sheet or panel. Therefore, when the motor is activated and the scrolling sheet scrolls between the spindles, the scrolling scene is visible from the outside of the gift bag.

With regard to the gift box, the gift box may include a base which contains four sides or panels which are arranged perpendicular to a bottom or floor panel, the side and floor panels creating an interior cavity or area for containing gifts or other items therein. The box may also include a lid which contains a top or cover panel with four sides or panels which are arranged perpendicular to the cover panel. The lid is slightly larger than the base so that the lid fits snugly over the top of the base to provide a covered, closed interior space therein. While the box is being described herein as having four sides, as in a square or rectangular shape similar to a traditional box, the box may alternately contain three or more sides which are arranged various configurations, such as a triangular configuration, pentagonal, octagonal, etc. The box may alternatively contain a single curved side wall panel arranged in a circular arrangement. The base and lid of the box would take on the same shapes in each circumstance. In a preferred embodiment, however, the box contains four sides. The box may be made of cardboard, corrugate, plastic, wood, or any other suitably strong material. The outer surface of the box may contain a planar sheet material attached thereto to provide a decorative effect. The planar sheet material may have various textures, such as a smooth texture, glossy texture, rough texture, embossed texture, furry texture, etc. The sheet material may also contain various embellishments attached thereto, including but not limited to gems, googly eyes, or other such attachments. The lid many be completely separate from the base or it may be a hinged lid which is permanently attached thereto along one side edge. Alternatively, the lid may be removably attached to the base via a snap, Velcro®, or other releasable attachment mechanism.

In a preferred embodiment, the gift box contains a closed area or cavity in the uppermost to top portion of the lid. A backing panel is positioned perpendicular to and between the four sides or edges of the lid. A cover panel, having at least one opening thereon is positioned perpendicular to and between the four sides or edges of the lid and parallel and spaced apart from the backing panel. The area between the backing and cover panels creates a first closed cavity wherein the scrolling mechanism is contained. The scrolling mechanism is visible through the at least one opening on the cover panel. The electronic components of the gift box are also contained within the space between the cover and backing panels of the gift box lid. The at least one opening on the cover panel is only large enough to see the scrolling mechanism and the remaining electronic components are concealed within the cavity. The electronic components of the gift box may include, but are not limited to: a circuit board; an integrated circuit chip; a speaker; a memory storage device; a power source; a motor; a switch, related circuitry and wiring; and any other item which is required or which facilitates audio capabilities, motor movement, light illumination, or any other special effect. These components are readily known to one having skill in the art so will not be discussed herein in further detail. Any type of switch or trigger mechanism may be used to activate the motor and initiate movement of the scrolling scene. Examples include, but are not limited to: push button, pull-tab or pull-string, slide tongue, light-sensitive switch, tilt switch, movement-sensitive switch, touch-sensitive switch, sound-sensitive switch, and contact switch. The switch may be contained on the base portion of the box or on the lid, or both. The box may additionally include a sound module which is operative to store and playback at least one audio file. The same switch or trigger mechanism may be used to activate the motor and sound modules or separate switch or trigger mechanisms may be used. The box may contain additional special effects such as lights.

In yet another embodiment of the present invention, a greeting card contains an item which is removably attached to the greeting card which contains the scrolling scene mechanism therein. The items may include wearable items such as a bracelet, necklace or a pin, or may be other sentimental token items such as a plush/stuffed animal, a pair of binoculars, a magnet, or other such keepsake.

The greeting card body may contain one or more greeting card panels. The greeting card may contain one panel in a postcard-type configuration. The greeting card may also have two panels attached along a fold line, similar to a traditional greeting card. Or the greeting card may contain three panels folded into a gate fold, s-fold or z-fold. The greeting card may also have more than three panels and may have panels which are folded around a frame containing electronics and other internal components therein.

An item containing a scrolling mechanism is removably attached to the greeting card. The item may be attached via low-tack glue or other type of adhesive or attachment mechanism. Alternatively, the item may be placed into a pocket or cavity attached to or within the greeting card. The item may be attached to the front of the greeting card or may be contained on the inside of the greeting card.

The scroll mechanism, as described above with respect to the other embodiments of the present invention, contains a two spindles or rollers 28A, 28B, a small motor 26, a gear mechanism 30, a rubber band 32, and a scroll sheet 34 which is attached end to end, forming a loop. The entire scrolling mechanism 16 is contained within a hard plastic shell 40. The miniature motor 26 contains a small gear head 26H which when activated spins or rotates. The gear head 26H is in contact with at least one of a plurality of gears 30 contained in the gear mechanism. Once the motor 26 is activated the gear head 26H rotates, causing the gears 30 of the gear mechanism to rotate as well. Two spindles or rollers 28A, 28B are positioned parallel to and spaced apart from each other at a distance that is approximately equal to the width of the scroll sheet loop 34. A small rubber band 32 is looped at one end around one of the gears 30 and at the opposite end around one of the rollers 28A. The scroll sheet loop 34 is attached between the two rollers or spindles 28A, 28B. Therefore, when the motor 26 is activated, the gear head 26H turns the gears 30 in the gear mechanism which in turn causes rotation of one of the spindles or rollers 28A, 28B via the rubber band 32. The scroll sheet 34 then scrolls or loops continuously between the two rollers 28A, 28B for as long as the motor 26 is activated. The scroll sheet 34 is made of a very thin material which has a scene or message printed thereon. The scene is printed from one edge of the film to the opposite edge. The two ends or edges of the material 34 are attached to one another, forming a loop. Once the loop 34 is attached between the rollers 28A, 28B and the motor 26 is activated, the material 34 scrolls across the "screen" and is visible through the opening 12 in the greeting card panel 10B and the acetate screen or cover. The scroll material loop 34 continues to rotate about the two rollers 28A, 28B until the motor module 26 is deactivated. In this embodiment, the two spindles or rollers 28A, 28B are placed in a horizontal configuration with the scroll sheet 34 looping between the spindles or rollers 28A, 28B in an up and down direction, as shown in the figures.

Since the entire scrolling mechanism 16 is contained within a hard plastic shell 40, it can easily be placed into different gift items. In one example, the scrolling mechanism can be placed into a wearable item, such as a necklace where the scroll mechanism is the charm which is suspended from a chain, wire or other such device. The hard plastic shell may be covered by a decorative housing which covers the perimeter and back side of the shell or may contain a decorative border which just covers the perimeter of the shell. Similarly, the scrolling mechanism can be placed into a bracelet or a pin which can also be worn by the recipient. Or the scrolling mechanism may be placed onto a large belt which may be made of paperboard or other foldable material that can be folded and attached to the greeting card. The belt may contain a fastening mechanism such as Velcro® to close the belt around ones waist. The belt may be a novelty gift item resembling a wrestling or boxing title belt having the scrolling mechanism contained on the front face thereof. The scroll may contain works or other sentiment or artwork which can be given as a novelty on Father's Day, birthday, or other congratulatory occasion. In another example, the scrolling mechanism may be placed into a collapsible set of binoculars. The binoculars may be foldable such that they can be put into a flat configuration for easy storage within or attachment to a greeting card. The binoculars contain various fold lines and interlocking tabs which are used to erect the binoculars so that they can be held up to one's eyes to view the scrolling scene placed on the inside of the structure. In another example, the scrolling scene may be placed onto or into the body of a plush or stuffed toy, such as a teddy bear or doll. The scrolling scene may be placed into the belly or stomach area of the toy so that an entertaining scene can be shown when the device is activated. The scrolling scene may also be placed into non-plush toys.

In addition to the scroll mechanism contained within the hard shell, each of the items onto or into which the scroll mechanism is attached, must also contain a small amount of space to accommodate electronic components which are necessary to make the scrolling mechanism move. These electronic components may include, but are not limited to: a circuit board, an integrated circuit chip, a memory storage device, a power source, a motor, a speaker, a switch, and related wire and circuitry, and any other electronic or other type of component which is required or which facilitates motor movement, audio capabilities or other special effect, such as lighting. These electronic components are known to one with skill in the art and are not discussed in further detail herein. The electronic components may be contained in a small pocket, cavity proximate to the scrolling mechanism such that they can be electronically attached or connected thereto.

The scrolling scene may be activated by a variety of different switch or trigger mechanisms. Some switch or trigger mechanism work better with different configurations or items as described above. Switch or trigger mechanisms that can be used in association with the items described above include, but are not limited to: a push button, a pull-tab or pull-string, a tilt switch, a motion sensitive switch, a light sensitive switch, a touch sensitive switch, a sound sensitive switch, a contact switch, a slide tongue switch, a magnetic switch, a lever, a crank or any other feasible switch or trigger mechanism. The switches may be triggered by user interaction with the item, such as, for example, pushing on the paw or hand of a plush toy or by moving a small lever attached to a necklace or bracelet or by fastening a clasp or button on a belt. Other switches may be triggered automatically by exposure to light, sound or movement.

With regard to all of the embodiments of the present invention described above, additional features may be added such as lights which may flash randomly or in a programmed pattern when a switch is activated. A sound module may be included which is operative to store and playback at least one audio file. These additional features may be activated using the same switch as that used to activate the motor attached to the scrolling mechanism or they may be activated by a separate switch (of the same or different type).

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated.

The invention claimed is:

1. A greeting card comprising:

a multi-panel greeting card body having at least one enclosure therein;

a scrolling mechanism operative to move a scroll with a scenic picture printed thereon on a loop, the scenic picture visible through an opening on at least one panel of the multi-panel greeting card body;

a motor module which is in contact with the scrolling mechanism;

a moveable object which is moveable by a user-interactive movement mechanism, the moveable object located in front of the scenic picture printed on the scroll of the scrolling mechanism;

a switch mechanism which activates the motor module causing movement of the scroll;

wherein a user can move the moveable object via the user-interactive movement mechanism in relation to the scenic picture printed on the scroll.

2. The greeting card of claim 1, wherein the user-interactive movement mechanism is a wheel.

3. The greeting card of claim 1, wherein the user-interactive movement mechanism can move the moveable object in left and right directions.

4. The greeting card of claim 1, further comprising a sound module operative to store and playback at least one audio file.

5. The greeting card of claim 4, wherein the switch mechanism also activates the sound module initiating playback of the at least one audio file.

6. The greeting card of claim 1, wherein the moveable object is a die cut shape.

7. A greeting card comprising:

a multi-panel greeting card body;

a scroll mechanism contained within the multi-panel greeting card body, the scroll mechanism operative to move a scenic picture on a loop;

a moveable object located proximate to the scenic picture;

a user-interactive movement mechanism which causes movement of the moveable object;

a user-interactive switch mechanism operative to begin looping movement of the scenic picture;

wherein a user can navigate the moveable object with respect to the scenic picture using the user-interactive movement mechanism.

8. The greeting card of claim 7, wherein the user-interactive switch mechanism is a lever attached to a slide tongue switch.

9. The greeting card of claim 8, wherein the scenic picture begins to move when the lever is pulled downward.

10. The greeting card of claim 9, wherein the scenic picture stops moving when the lever is pushed upward.

11. The greeting card of claim 7, wherein the moveable object can be moved in left and right directions.

12. The greeting card of claim 7 further comprising a sound module operative to store and playback at least one audio file upon activation of the user-interactive switch.

13. The greeting card of claim 7, wherein the scenic picture is visible from the front of the greeting card.

14. A greeting card comprising:

a greeting card body;

a scroll mechanism contained within the greeting card body, the scroll mechanism operative to move a scenic picture on a loop;

a motor operative to provide power to allow the scroll mechanism to move the scenic picture on a loop;

a mobile object located above the moveable scenic picture, the mobile object operative to move in left-and-right directions;

a switch operative to control activation of the motor;

wherein a user can control movement of the mobile object; and wherein the moveable scenic picture and the mobile object are thematically related.

15. The greeting card of claim 14, wherein the user can control movement of the mobile object using a movement mechanism attached to the greeting card.

16. The greeting card of claim 15, wherein the movement mechanism is a wheel.

17. The greeting card of claim 14, wherein the switch requires user interaction therewith.

18. The greeting card of claim 14, wherein the mobile object is a die cut shape.

19. The greeting card of claim 14, wherein the switch is a slide tongue switch.

* * * * *